US006525487B2

(12) United States Patent
Wei

(10) Patent No.: US 6,525,487 B2
(45) Date of Patent: Feb. 25, 2003

(54) LIGHT DRIVER FOR SHOE

(76) Inventor: Meng Pi Wei, 3F, No. 238, Pao Ping Rd., Yungho City, Taipei Hsien (TW)

( * ) Notice: Subject to any disclaimer, the term of this patent is extended or adjusted under 35 U.S.C. 154(b) by 0 days.

(21) Appl. No.: 09/903,552

(22) Filed: Jul. 13, 2001

(65) Prior Publication Data

US 2003/0011325 A1 Jan. 16, 2003

(51) Int. Cl.[7] ..... H05B 37/00
(52) U.S. Cl. ..... 315/200 A; 315/307; 315/362; 362/800; 362/227; 362/276
(58) Field of Search ..... 315/200 A, 51, 315/307, 360, 362; 362/157, 227, 276, 800

(56) References Cited

U.S. PATENT DOCUMENTS 4,797,864 A * 1/1989 Stano et al. ..... 368/107
5,644,858 A * 7/1997 Bemis ..... 36/136
5,813,148 A * 9/1998 Guerra ..... 36/137
5,821,697 A * 10/1998 Weber ..... 315/200 A
5,895,326 A * 4/1999 Cozza et al. ..... 473/213

* cited by examiner

*Primary Examiner*—Haissa Philogene
(74) *Attorney, Agent, or Firm*—Rosenberg, Klein & Lee

(57) ABSTRACT

A light driver for shoe comprises a power source, a switch unit, a controller, and a plurality of LEDs. The power source is composed of a first battery and a second battery in serial arrangement to provide two kinds of levels for LEDs with different characteristics. The switch unit is connected to an input of the controller, and the LEDs are connected to an output of the controller. The controller receives a triggering signal from the switch unit and drives the LEDs to flash.

12 Claims, 5 Drawing Sheets

LIGHT DRIVER FOR SHOE

FIELD OF THE INVENTION

The present invention relates to a light driver for shoe, especially to a light driver providing two kinds of voltage levels for the flashing light on shoe.

BACKGROUND OF THE INVENTION

FIG. 1 shows a prior art light driver comprising a button 1*a*, a controller 2*a*, a plurality of LEDs (light emitting diodes) 3*a* and a power source 4*a*. The button 1*a* is connected to an input of the controller 2*a* and the controller 2*a* has an output connected to the plurality of LEDs 3*a*. The power source 4*a* generally provides 3V voltage to the LEDs 3*a* and the controller 2*a*. The button 1*a* is pressed to generate a triggering signal to the controller 2*a*, which then drives the LEDs 3*a* to lighten in various flash modes.

In above flashing light can use LEDs of various colors to provide more colorful light. However, the LEDs of different colors require driving voltages of various levels. For example, the red, yellow, and green LEDs need driving voltage of 3V. The blue, white, purple and pink LEDs need driving voltage above 3.6V, otherwise, those LEDs will have dimmish light.

The conventional light driver generally uses an operation voltage of mono level. If the operation voltage complies with the operation voltage of the red, yellow, and green LEDs, the blue, white, purple and pink LEDs will have dimmish light. On the contrary, if the operation voltage complies with the operation voltage of the blue, white, purple and pink LEDs, the red, yellow, and green LEDs have risk of burning down.

SUMMARY OF THE INVENTION

It is the object of the present invention to provide a light driver providing two kinds of voltage levels for the flashing light on shoe.

To achieve above object, the present invention provides a light driver for shoe having a power source, a switch unit, a controller, and a plurality of LEDs. The power source is composed of a first battery and a second battery in serial arrangement to provide two kinds of levels for LEDs with different characteristics. The switch unit is connected to an input of the controller, and the LEDs are connected to an output of the controller. The controller receives a triggering signal from the switch unit and drives the LEDs to flash.

The various objects and advantages of the present invention will be more readily understood from the following detailed description when read in conjunction with the appended drawing, in which:

DETAILED DESCRIPTION OF THE INVENTION

Figure 1:
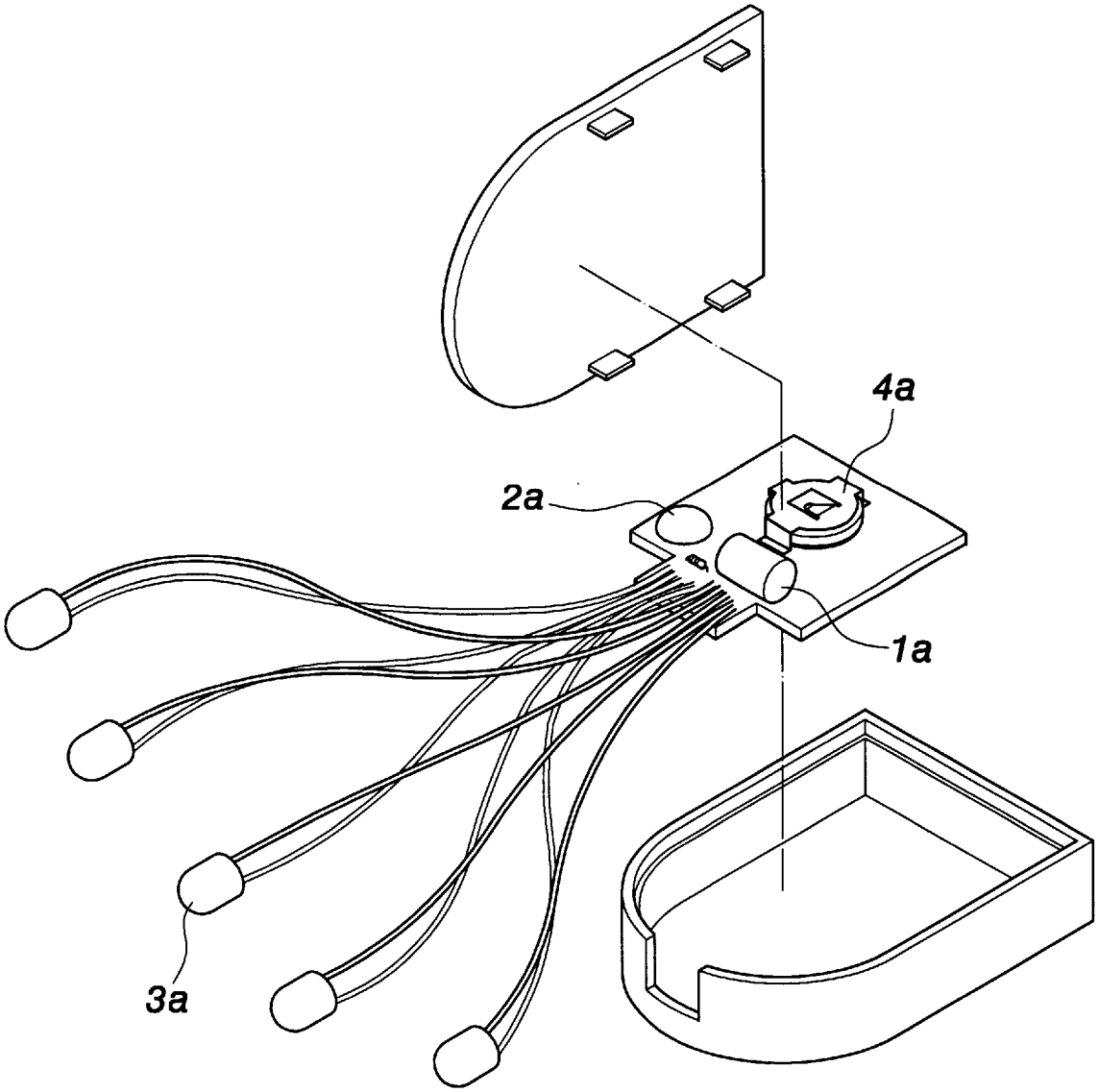
FIG. 1 PRIOR ART
FIG. 1 shows a prior art light driver.
Figure 2:
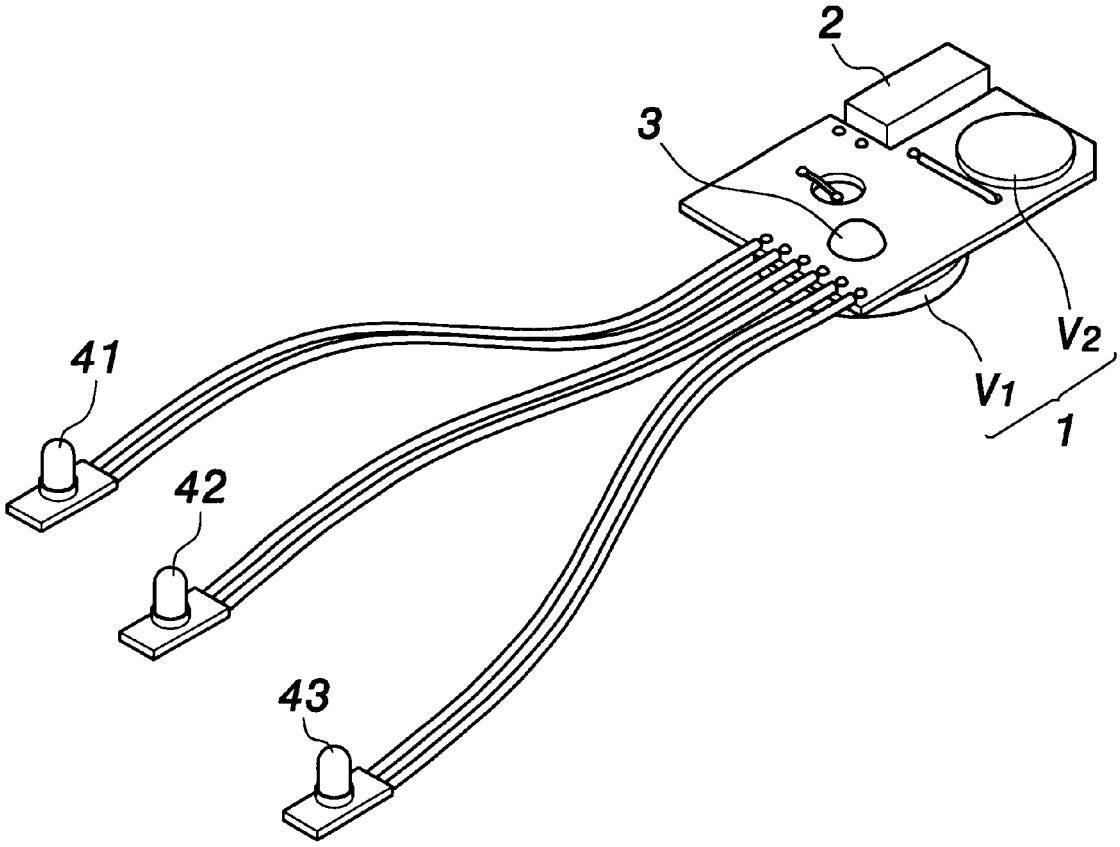
FIG. 2 is a perspective view of the light driver of the present invention.
Figure 3:
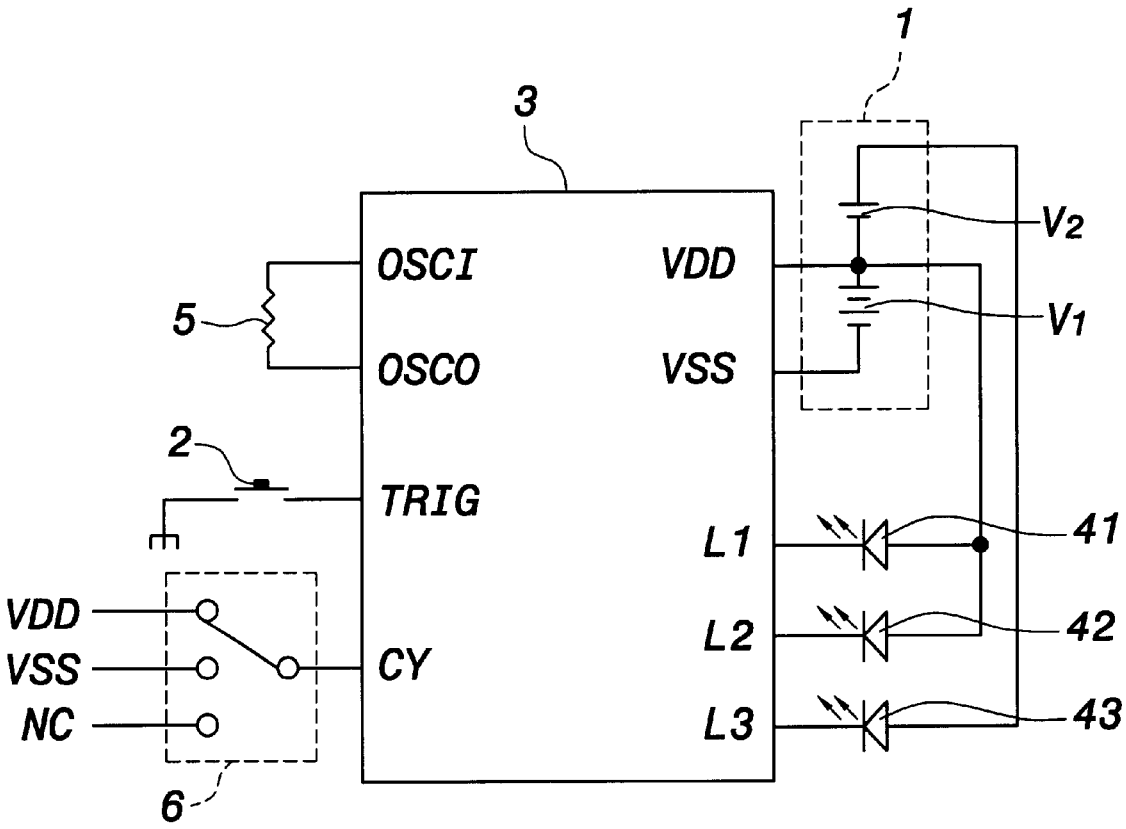
FIG. 3 shows the controller of the light driver of the present invention.

With reference now to FIGS. 2 and 3, the present invention is intended to provide a light driver for shoe. The light driver comprises a power source 1, a switch unit 2, a controller 3, a red LED 41, a green LED 42, and a blue LED 43.

The power source 1 comprises a first battery V1 of 3 volt and a second battery V2 of 1.5 volt in serial connection, thereby providing driving voltages of various levels to the red LED 41, the green LED 42, and the blue LED 43. Moreover particularly, the total voltage provided by the serially connected first battery V1 and second battery V2 is 4.5 volt. The anode of the first battery V1 is connected to the anode of the red LED 41 and the anode of the green LED 42, wherein the first battery V1 is a CR-2032 battery. The anode of the second battery V2 is connected to the anode of the blue LED 43. By above arrangement, the power source 1 can provide driving voltages of 4.5 volt and 3 volt to the red LED 41, the green LED 42, and the blue LED 43, respectively.

The controller 3 is a controlling IC with a TRIG pin connected to the switch unit 2, a CY pin connected to a flashing mode switch 6, L1–L3 pins connected to the cathodes of the red LED 41, the green LED 42, and the blue LED 43, a VDD pin connected to the anode of the first battery V1, the cathode of the second battery V2 and the anodes of the red LED 41 and the anode of the green LED 42, a VSS pin connected to the cathode of the first battery V1. The controlling IC further has an OSC1 pin and an OSC0 pin connected to both ends of an oscillating resistor 5, which is used to adjust the oscillation frequency.

The controlling IC generates a flashing signal to the red LED 41, the green LED 42, and the blue LED 43, respectively upon receiving a triggering signal from the switch unit 2. The flashing signal is sent to the flashing mode switch 6 for providing three different flashing modes.

Figure 4:
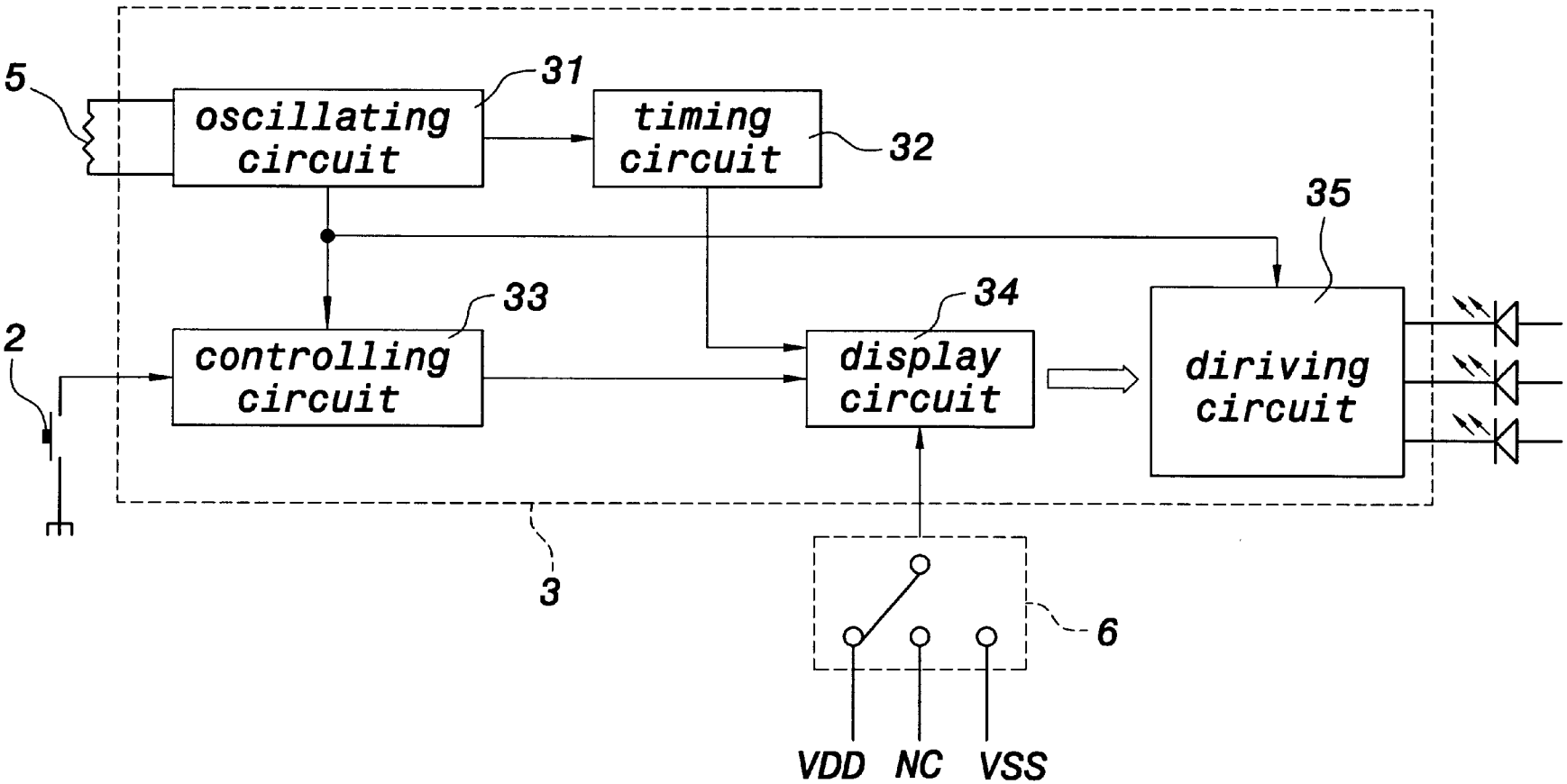
FIG. 4 shows the block diagram of the controller of the light driver of the present invention.

FIG. 4 shows the block diagram of the controller 3, which comprises an oscillating circuit 31, a timing circuit 32, a controlling circuit 33, a display circuit 34 and a driving circuit 35. The oscillating circuit 31 has an output connected to the timing circuit 32,the controlling circuit 33, and the display circuit 34, and an input connected to the oscillating resistor 5. The controlling circuit 33 has an output connected to the display circuit 34, the display circuit 34 has an output connected to the driving circuit 35. The driving circuit 35 has an output connected to a plurality of LEDs.

The oscillating circuit 31 generates a clock signal with frequency determined by the oscillating resistor 5. The clock signal is functioned as timing reference for other circuits.

The controlling circuit 33 is in pending state until it receives the triggering signal from the switch unit 2. The controlling circuit 33 generates no signal in pending state and generates an activating signal to the display circuit 34 as receiving the triggering signal from the switch unit 2.

The timing circuit 32 receives the clock signal from the oscillating circuit 31 and provides a timing signal to the display circuit 34 such that the display circuit 34 exhibits visual effect for a flash period determined by the timing circuit 32.

The display circuit 34 receives the activating signal from the controlling circuit 33 and the timing signal from the timing circuit 32. Moreover, the display circuit 34 receives a flash mode from the flashing mode switch 6, and then sends a flashing signal characterized by the flash period and the flash mode to the driving circuit 35.

The driving circuit 35 drives the plurality of LEDs with reference to the flashing signal. The LEDs have a flashing frequency synchronous with the clock signal.

Moreover, to prevent the problem of everlasting triggering signal caused by erroneously keeping on pressing the switch unit 2, the flash period comprises an active duration and an idle duration. The display circuit 34 sends the flashing signal in response the flash mode from the flashing mode switch 6 during the active duration, and does not send the flashing signal during the idle duration, thereby reducing the power consumption of the LEDs. The additional triggering signal is invalid until the flash period is over.

Figure 5:
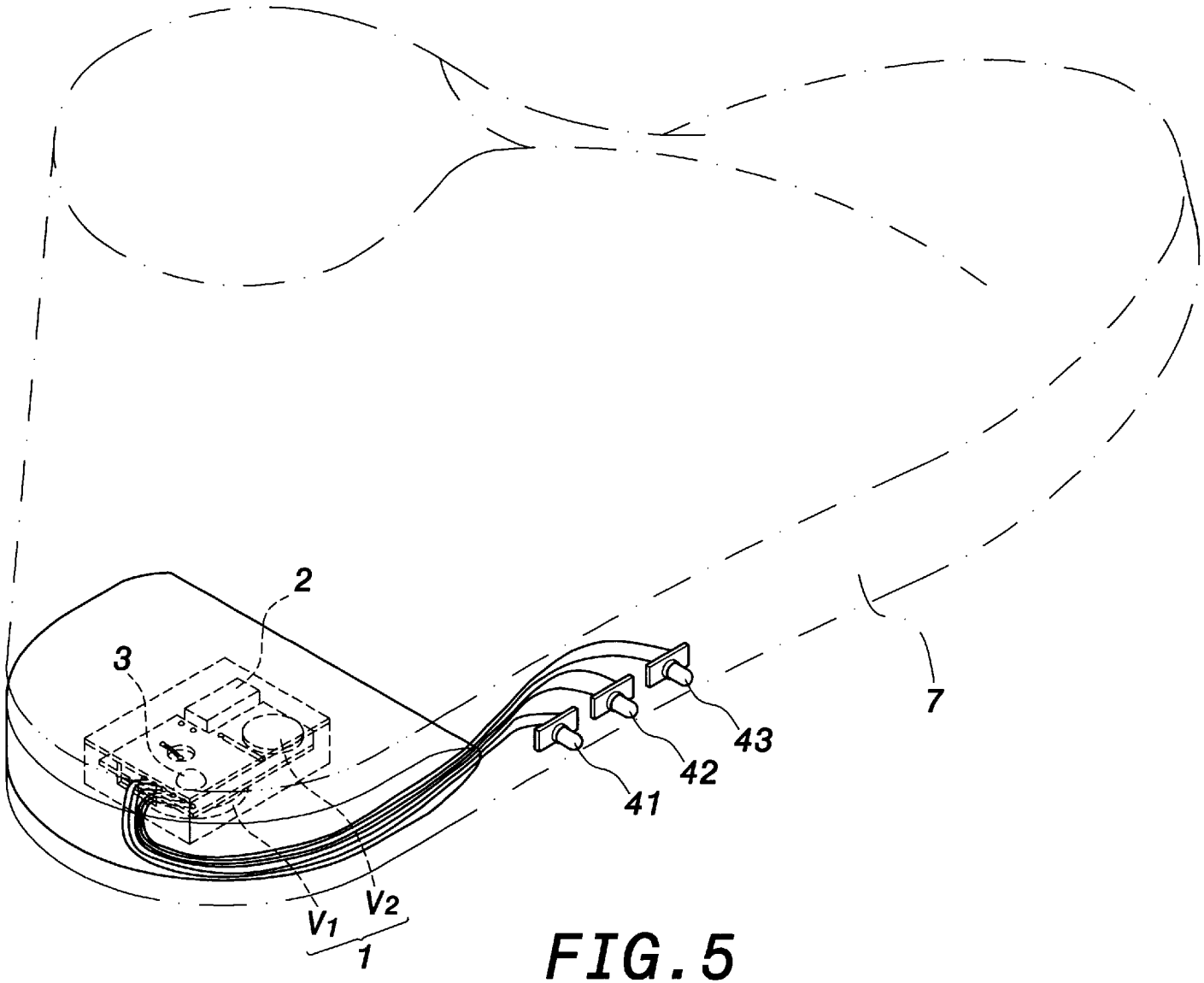
FIG. 5 shows the application of the light driver of the present invention.

With reference now to FIG. 5, the inventive light driver can be arranged at heel portion of a shoe. The red LED 41, the green LED 42, and the blue LED 43 emit light with flash mode decided by the flashing mode switch 6 and with the flash period. Moreover, the red LED 41, the green LED 42, and the blue LED 43 can also be arranged at other position on the shoe for decoration and warming.

To sum up, the inventive light driver for shoe has following advantages:

(1) Providing two different operation voltages to the LEDs of various kinds.

(2) Saving power consumption.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A light driver for shoe, comprising a controller, a power source coupled to the controller, a switch unit coupled to the controller, and a plurality of LEDs, the plurality of LEDs including at least two LEDs having different operating voltages, the power source including a first battery of 3 volts and a second battery of 1.5 volts coupled in a series arrangement with a node therebetween to provide a 3 volt level between a reference terminal and the node and a 4.5 volt level between the reference terminal and an anode of the series coupled batteries, the node and reference terminal being coupled to the controller and the anode of the series coupled batteries being coupled to at least one LED, the switch unit generating a triggering signal upon being pressed and the controller controlling a flashing mode of the LEDs after receiving the triggering signal.

2. The light driver for shoe as in claim 1, wherein the first battery is a CR-2032 battery.

3. The light driver for shoe as in claim 1, wherein the LEDs emit light of at least one following color: red, yellow, green, blue, white, purple, and pink.

4. The light driver for shoe as in claim 1, wherein the controller comprises an oscillating circuit, a timing circuit, a controlling circuit, a display circuit and a driving circuit.

5. The light driver for shoe as in claim 1, wherein the switch unit continues to generate the triggering signal when the switch unit is kept in a pressed state until the pressed state is released and a flash period is over.

6. The light driver for shoe as in claim 4, wherein the oscillating circuit is connected to an oscillating resistor and provides a clock signal.

7. The light driver for shoe as in claim 4, wherein the timing circuit is connected to the oscillating circuit and provides a timing signal.

8. The light driver for shoe as in claim 4, wherein the controlling circuit is connected to the switch unit, the controlling circuit produces an activating signal to the display circuit when the switch unit is pressed and with reference to a clock signal.

9. The light driver for shoe as in claim 4, wherein the display circuit is connected to a flashing mode switch and sends a flashing signal in cooperation with a flash period to the driving circuit with reference to a timing signal and a activating signal.

10. The light driver for shoe as in claim 4, wherein the driving circuit is connected to the LEDs and drives the LEDs to flash upon receiving a flashing signal containing a flash mode selected by a flashing mode switch, the LEDs having a flashing frequency synchronous with a clock signal.

11. The light driver for shoe as in claim 9, wherein the flash period comprises an active duration and an idle duration, the display circuit sends the flashing signal during the active duration, and does not send the flashing signal during the idle duration, thereby reducing power consumption of the LEDs.

12. The light driver for shoe as in claim 9, wherein additional triggering signal is invalid until the flash period is over.

* * * * *